US005516090A

United States Patent [19]

Chang

[11] Patent Number: 5,516,090

[45] Date of Patent: May 14, 1996

[54] MOUNTING ARRANGEMENT FOR A BINDING LINE

[75] Inventor: Bobby Chang, Thousand Oaks, Calif.

[73] Assignee: R. R. Donnelley & Sons Company, Lisle, Ill.

[21] Appl. No.: 231,243

[22] Filed: Apr. 22, 1994

[51] Int. Cl.[6] ..... B65H 39/04; B65G 43/08

[52] U.S. Cl. ..... 270/54; 198/464.4

[58] Field of Search ..... 270/54, 55; 198/464.4; 271/265.01, 258.01, 258.04

[56] References Cited

U.S. PATENT DOCUMENTS

| | | | |
|---|---|---|---|
| 3,525,516 | 8/1970 | Bushnell et al. . | |
| 4,034,974 | 7/1977 | Maopolski . | |
| 4,078,784 | 3/1978 | Miaskoff et al. . | |
| 4,564,186 | 1/1986 | Clarke, Jr. et al. | 198/644 X |
| 4,799,661 | 1/1989 | Nail . | |
| 4,917,367 | 4/1990 | Sterne et al. | 270/54 X |
| 4,986,521 | 1/1991 | Bulka et al. | 270/58 X |
| 5,067,700 | 11/1991 | Dick | 270/55 |
| 5,080,337 | 1/1992 | Mayer et al. | 270/54 X |
| 5,213,318 | 5/1993 | Newhall . | |

*Primary Examiner*—John E. Ryznic

*Attorney, Agent, or Firm*—Marshall, O'Toole, Gerstein, Murray & Borun

[57] ABSTRACT

An improvement in a binding line comprises a mounting device for mounting gathering assist apparatus in a fixed position with respect to a binding chain and independently from a packer box. The packer box can then be moved away from the binding chain without affecting the position of the gathering assist apparatus. Frequent repositioning and recalibration of the gathering assist apparatus is thereby avoided and the chance of damage thereto is minimized.

19 Claims, 2 Drawing Sheets

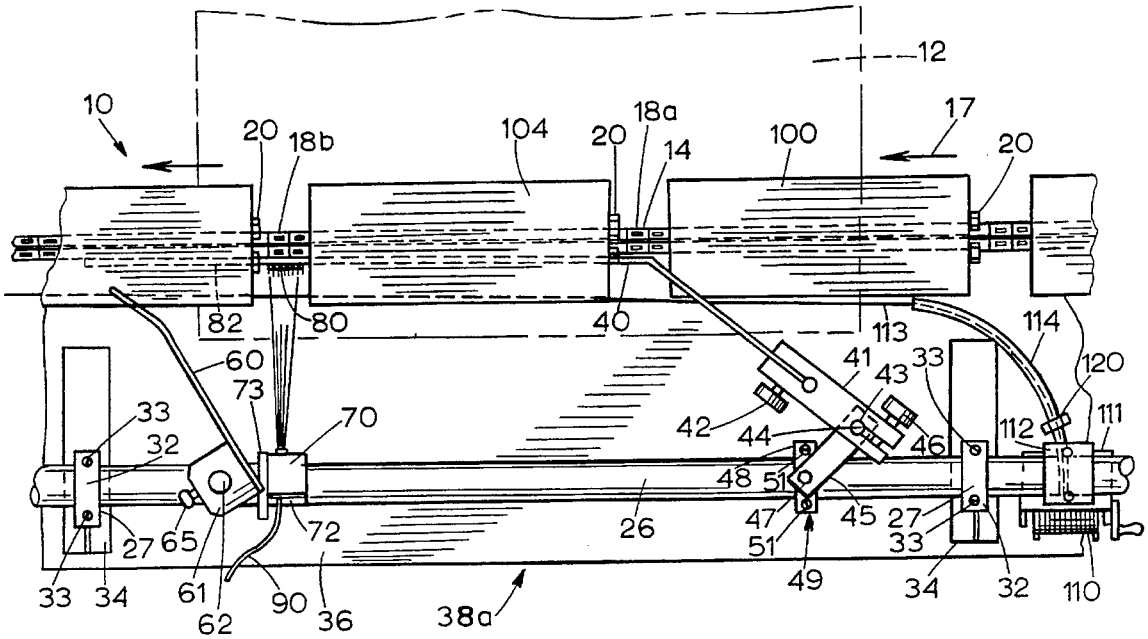
FIG. 3
FIG. 4
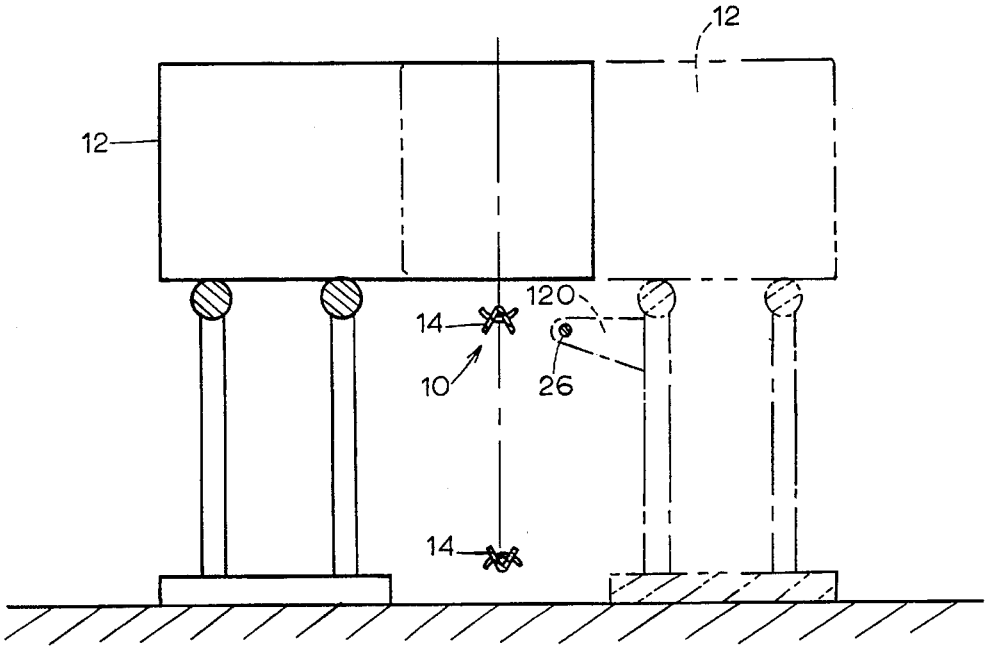

MOUNTING ARRANGEMENT FOR A BINDING LINE

TECHNICAL FIELD

The present invention relates generally to binding lines, and more particularly to a mounting arrangement for gathering assist apparatus used on a binding line.

BACKGROUND ART

Printed and bound materials, such as magazines and the like, are typically produced on a binding line. Specifically, a plurality of packer boxes are disposed adjacent a gathering or binding chain wherein each packer box stores a plurality of signatures. The binding chain includes a plurality of chain pins defining chain spaces which are moved past the packer boxes. During such movement, the packer boxes are operated to feed signatures onto the chain spaces. The assembled signatures are then stitched, trimmed and prepared for shipment.

During operation of the binding system, defective books can be produced as a result of, for example, misfeeds of signatures, misalignment or improper positioning of gathered signatures and the like. A first drag (referred to as a "Higgins drag" by the assignee of the instant application) is carried by each packer box and includes a spring-loaded drag blade which contacts the signatures fed by the preceding packer boxes. A second drag is also carried by each packer box and is located downstream of the first drag and includes a drag which pulls the signature fed by the packer box against one of the chain pins so that the signatures are properly aligned in the chain spaces. In addition, a trailing portion of each Higgins drag includes a reflective surface and an opto-electronic sensor is mounted on each packer box and is directed at the reflective surface. The output of each opto-electric sensor is detected during a predetermined period in each packer box feeding sequence. If a signature has been properly placed on the chain by a packer box, the signature will cover the reflective surface during the predetermined period and the output of the sensor will be in a first state. On the other hand, if a signature has not been properly fed onto the chain, the reflective surface will not be covered during the predetermined period and the output of the sensor will be in a second state during such time. The output of the sensor is utilized by a controller to operate a reject gate downstream of the packer boxes if such a misfeed condition is sensed so that the defective group of signatures is removed from the binding line.

During the setup procedure for the binding line, individual packer boxes are either moved into or out of the binding line adjacent the chain. Often this movement of the packer boxes results in misalignment of and/or damage to the opto-electronic sensors and drags. Such misalignment and damage can result in erroneous fault detection due to improper electrical timing of the sensor. Also, the need to accurately position the sensors and drags undesirably increases the period of time needed to set up the binding line, and thus increases the down time between production runs.

SUMMARY OF THE INVENTION

The present invention eliminates the foregoing difficulties by providing a mounting arrangement for gathering assist apparatus which is fixed relative to the binding line and independent of the packer boxes.

More specifically, according to one aspect of the present invention, an improvement in a binding line having a movable binding chain, a packer box adjacent the chain which is operable to feed signatures on the chain and gathering assist apparatus associated with the packer box for assisting with gathering of signatures comprises a mounting device for mounting the gathering assist apparatus in a fixed position with respect to the binding chain and independently from the packer box so that the packer box can be moved away from the binding chain without affecting the position of the gathering assist apparatus.

According to one embodiment, the mounting device comprises a mounting rail and the gathering assist apparatus comprises a sensor and/or a drag.

According to another embodiment, the gathering assist apparatus comprises a string reel carried by the mounting device.

Also preferably, the mounting device is hollow and the gathering assist apparatus develops a signal which is supplied over a wire to a controller wherein the wire is disposed within the hollow mounting device.

According to a further aspect of the present invention, an improvement in a binding line having a plurality of packer boxes adjacent a movable binding chain and gathering assist apparatus associated with each packer box includes means for mounting each gathering assist apparatus in a fixed position with respect to the binding chain and independently from the associated packer box so that the packer box can be moved away from the binding chain without affecting the position of the gathering assist apparatus.

In accordance with yet another aspect of the present invention, a binding line includes a movable binding chain, a plurality of packer boxes adjacent the chain which are independently operable to feed signatures on the chain and a mounting rail disposed in a fixed position with respect to the binding chain and independently from the packer boxes. Gathering assist apparatus is associated with each packer box and carried by the mounting device and includes a drag and a sensor for sensing a portion of the drag associated with each packer box.

By mounting the gathering assist apparatus on a mounting device which is independent from the packer boxes, the packer boxes can be moved out of the binding line without risk of damage to the gathering assist apparatus and without the need to reposition the gathering assist apparatus each time a packer box is moved. Thus, down time of the binding line is minimized. Also, the fixed mounting rail provides a fixed mechanical reference for positioning of devices, for example, where a packer box is to be mounted on the opposite side of the binding chain.

BRIEF DESCRIPTION OF THE DRAWINGS

FIG. 3 comprises a plan view of the binding chain and mounting arrangement of the present invention shown in FIG. 2; and FIG. 4 comprises an end elevational view, partially in section, of the binding line of FIG. 1.

DESCRIPTION OF THE PREFERRED EMBODIMENTS

Figure 1:
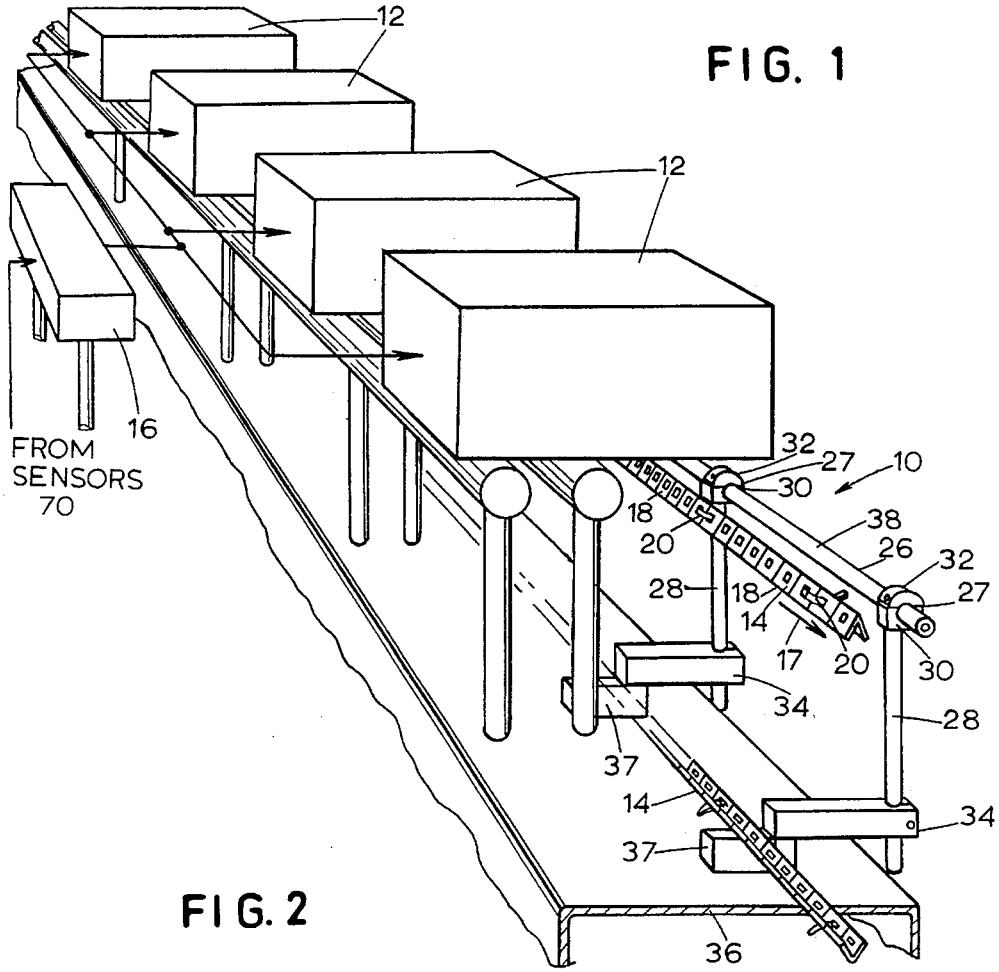
FIG. 1 comprises a simplified perspective view of a binding line incorporating the present invention.

Referring now to FIG. 1, a binding line 10 includes a plurality of packer boxes 12 (shown in phantom in FIG. 3)

disposed adjacent a binding chain 14. The binding chain 14 is formed in an endless loop and is carried by support apparatus (not shown), which moves the chain 14 in the direction shown by the arrow 17 in the Figs. below the packer boxes 12 during a production run.

Figure 2:
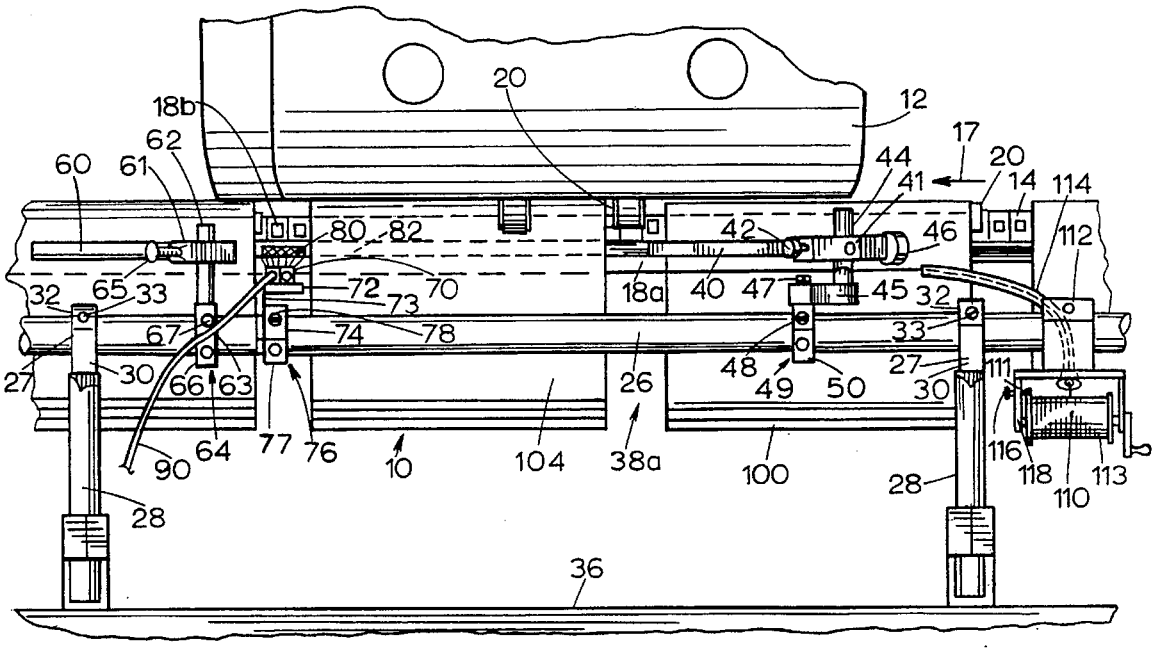
FIG. 2 comprises a simplified side elevational view of a portion of the binding line of FIG. 1 illustrating the mounting rail and gathering assist apparatus of the present invention.

With reference also to FIGS. 2 and 3, the binding chain 14 is divided into a plurality of chain spaces 18 by chain pins 20. Two chain spaces 18*a*, 18*b* are shown in FIGS. 2 and 3. As the binding chain 14 is moved during a production run the chain spaces 18 pass beneath the packer boxes 12 and the packer boxes are selectively operated to deposit signatures on the chain spaces 18 to thereby produce books.

With reference also to FIG. 4, a mounting rail 26, which may comprise an ordinary hollow conduit or pipe, is secured by a plurality of clamps 27 to a plurality of stanchions 28. Each clamp 27 includes a main portion 30 and a mating cap portion 32 which is secured to the main portion by bolts or screws 33. Each main portion 30 is secured to the associated stanchion 28 by a threaded connection therebetween or by any other suitable securing apparatus, such as a set screw or bolt extending through a part of the main portion into a recess therein continuing the stanchion 28.

Each stanchion 28 is secured in a bore extending through a mounting arm 34 and the mounting arms 34 are secured in any suitable fashion (for example by fasteners such as screws or bolts or by welds) to a base 36. The mounting arm may include a set screw or other similar device which may be loosened, if desired, to allow up and down positioning of the associated stanchion 28 and the mounting rail 26. Once the stanchion is properly positioned, the set screw may be tightened to maintain such position.

If necessary or desirable, other mounting apparatus such as mounting blocks 37 can be secured between the arms 34 and the base 36.

The details of the mounting of the rail 26 may be varied as needed for whatever reason, for example, where the apparatus is to be mounted on a different binding line. The only requirement is that the mounting rail 26 be maintained at a desired position relative to the binding chain 14 independent of the packer boxes 12.

The mounting rail 26 is subdivided into a plurality of rail portions 38, each comprising a possible location for mounting of gathering assist apparatus (not shown in FIG. 1) thereon adjacent an associated packer box 12. One rail portion 38*a* is shown in FIGS. 2 and 3. A first drag (also referred to as a "Higgins drag") 40 is retained within a slotted portion of an upper arm 41 by a thumbscrew 42. The upper arm 41 further includes a bore 43 which receives a spindle 44 carried by a lower arm 45. A thumbscrew 46 may be loosened to properly position the upper arm 41 relative to the lower arm 45 and thereafter tightened to retain the upper arm 41 in position. The lower arm 45 includes a bore through which a bolt 47 extends into a threaded bore in a first or upper portion 48 of a clamp 49. Once the lower arm 45 is positioned as desired, the bolt 47 is tightened to maintain such arm in a desired position. The clamp 49 further includes a second or lower portion 50 secured by screws or bolts 51 to the upper portion 48 such that the mounting rail 26 is captured therebetween and the drag 40 and associated apparatus are maintained in a fixed position.

A second drag 60 is likewise located at the rail portion 38 and is mounted on a carrier 61 by bolts, screws or other means. The carrier includes a bore which receives a spindle 62 carried by a first portion 63 of a clamp 64 identical to the clamp 49. The carrier 61 further includes a thumbscrew 65 which extends through a bore and which can be tightened to maintain the carrier 61 in a desired position. A second portion 66 of the clamp 64 is secured to the first portion 63 by screws or bolts 67 (only one is visible in FIG. 2) so that the mounting rail 26 is captured therebetween and the drag 40 and the carrier 61 are maintained in a fixed position. The first and second drags 40, 60 are spaced from one another and are disposed at opposite ends of the rail portion 38*a*.

An opto-electronic sensor 70 is mounted on a plate 72 in any suitable fashion and the plate 72 includes a downwardly extending flange 73 which is welded or otherwise secured to an upper portion 74 of a clamp 76 similar to the clamps 49 and 64. A lower portion 77 of the clamp 76 is secured to the upper portion 74 by screws or bolts 78 (again, only one is visible in FIG. 2) to maintain the sensor 70 in position. The sensor is directed at a reflective surface 80 disposed on a trailing portion 82 of the drag 40.

As noted in greater detail hereinafter, the sensor 70 develops a sensor signal which is supplied over a wire 90 to the controller 16. Inasmuch as the mounting rail 26 is hollow, the sensor wire 90 may pass through and be enclosed by the mounting rail, thereby minimizing the potential for damage to the wire 90.

During operation of the binding line 10, signatures are fed by the packer boxes 12 onto the chain spaces 18 of the binding chain 14 under control of the controller 16, as noted above. With specific reference to FIGS. 2 and 3, a group of signatures 100 previously fed onto the chain space 18*a* are contacted by and disposed behind the Higgins drag 40. The drag 40 also contacts a group of signatures located beneath a signature 104 fed onto the chain space 18*b* by a packer box 12 located at the rail portion 38*a*. As the binding chain 14 moves to the left as seen in FIGS. 2 and 3, the signature 104 passes over the reflective surface 80 of the drag 40 and blocks light directed by the sensor 70 thereon. The output signal developed by the sensor 70 during this predetermined portion of time in the feeding sequence of the packer box is therefore in a first state indicating proper feeding of the signature 104. On the other hand, if the signature 104 has been misfed and is not present in the chain space 18*b*, the light directed by the sensor 70 is reflected by the reflective surface 80 back to the sensor 70, causing the output of the sensor to be in a second state indicating the misfeed condition during the predetermined portion of the feed cycle.

Immediately following such operation the second drag 60 contacts the signature 104 (if properly fed) and pulls the signature into engagement with the chain pin 20 defining the chain space 18*b*. Thereafter, the group of signatures including the signature 104 are moved by the binding chain to other rail portions 38 where additional signatures may be added to the group.

If desired, one or more of the drags 40 and 60 and the sensor 70 may be omitted from some or all of the rail portions 38. Also, if desired, additional and/or different gathering assist apparatus may be mounted on the mounting rail 26 at some or all of the rail portions 38. For example, as seen in FIGS. 2 and 3, a string reel 110 rotatably retained by a reel carrier 111 may be mounted by a clamp 112 to the mounting rail 26. Again, the clamp 112 may be substantially similar to or identical to the clamp 49. String 113 from the reel 110 extends through guide tubing 114 and may be placed between gathered signatures to provide a convenient means of opening the group of signatures for printing of information on a particular signature portion or to deposit an insert at that point in the group of signatures. If necessary or desirable, a locking screw 116 (seen only in FIG. 2) may extend through a wall 118 of the reel carrier 111 and be engagable with the reel 110 to selectively prevent rotation thereof. Also, if necessary or desirable, the guide tubing may be supported by a tubing support member 120 (seen in FIG. 3) which is secured to a stable surface, such as the mounting rail 26.

Because the mounting rail 26 is mounted at a fixed distance from the binding chain 14, the rail can be used as a mechanical reference point for positioning other devices relative to the binding chain 14. For example, as illustrated by the dashed lines of FIG. 4, a packer box 12 mounted in reverse (i.e., placed on the opposite side of the binding chain 14) may be positioned by configuring the packer box 12 to include a projecting arm 120 which contacts the mounting rail 26 when the packer box 12 is correctly positioned with respect to the binding chain 14.

Because the gathering assist apparatus described above, namely the Higgins drag 40, the second drag 60, the sensor 70 and the string reel 110, are all mounted on the mounting rail 26, these devices are independent of the packer boxes 12. Accordingly, there is no need to reposition and/or recalibrate the gathering assist apparatus as packer boxes are moved into the rail portion 38, and the risk of damage to such components is minimized.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

I claim:

1. An improvement in a binding line having a movable binding chain, a packer box adjacent the chain which is operable to feed signatures on the chain and gathering assist apparatus associated with the packer box for assisting with gathering of signatures, the improvement comprising:

a mounting device for mounting the gathering assist apparatus in a fixed position with respect to the binding chain and independently from the packer box so that the packer box can be moved away from the binding chain without affecting the position of the gathering assist apparatus, wherein the gathering assist apparatus develops an indication of the operability of the packer box associated therewith.

2. The improvement of claim 1, wherein the mounting device comprises a mounting rail.

3. An improvement in a binding line having a movable binding chain, a packer box adjacent the chain which is operable to feed signatures on the chain and gathering assist apparatus associated with the packer box for assisting with gathering of signatures, the improvement comprising:

a mounting device for mounting the gathering assist apparatus in a fixed position with respect to the binding chain and independently from the packer box so that the packer box can be moved away from the binding chain without affecting the position of the gathering assist apparatus, wherein the gathering assist apparatus comprises a sensor.

4. The improvement of claim 3, wherein the gathering assist apparatus further includes a drag and the sensor is adapted to sense a portion of the drag.

5. The improvement of claim 3, wherein the gathering assist apparatus further comprises a drag carried by the mounting device.

6. The improvement of claim 3, wherein the gathering assist apparatus further comprises a string reel.

7. An improvement in a binding line having a movable binding chain, a packer box adjacent the chain which is operable to feed signatures on the chain and gathering assist apparatus associated with the packer box for assisting with gathering of signatures, the improvement comprising:

a mounting device for mounting the gathering assist apparatus in a fixed position with respect to the binding chain and independently from the packer box so that the packer box can be moved away from the binding chain without affecting the position of the gathering assist apparatus, wherein the mounting device is hollow and wherein the gathering assist apparatus develops a signal which is supplied over a wire to a controller and wherein the wire is disposed within the hollow mounting device.

8. An improvement in a binding line having a movable binding chain, a packer box adjacent the chain which is operable to feed signatures on the chain and gathering assist apparatus associated with the packer box for assisting with gathering of signatures, the improvement comprising:

a mounting device for mounting the gathering assist apparatus in a fixed position with respect to the binding chain and independently from the packer box so that the packer box can be moved away from the binding chain without affecting the position of the gathering assist apparatus, wherein the mounting device comprises a reference point for positioning of a device relative to the binding chain.

9. An improvement in a binding line having a movable binding chain, a plurality of packer boxes adjacent the chain which are operable to feed signatures on the chain and gathering assist apparatus associated with each packer box for assisting with gathering of signatures, the improvement comprising:

means for mounting each gathering assist apparatus in a fixed position with respect to the binding chain and independently from the associated packer box so that the associated packer box can be moved away from the binding chain without affecting the position of the gathering assist apparatus, wherein each gathering assist apparatus comprises a sensor.

10. The improvement of claim 9, wherein the mounting means comprises a single mounting member.

11. The improvement of claim 9, wherein the mounting means comprises a mounting rail.

12. The improvement of claim 9, wherein the gathering assist apparatus further includes a drag and the sensor is adapted to sense a portion of the drag.

13. The improvement of claim 9, wherein the gathering assist apparatus further comprises a drag.

14. The improvement of claim 9, wherein the gathering assist apparatus further comprises a string reel.

15. The improvement of claim 9, wherein the mounting means is hollow and wherein the gathering assist apparatus develops a signal which is supplied over a wire to a controller and wherein the wire is disposed within the hollow mounting means.

16. A binding line, comprising:

a movable binding chain;

a plurality of packer boxes adjacent the chain which are independently operable to feed signatures on the chain;

a mounting rail disposed in a fixed position with respect to the binding chain and independently from the packer boxes; and gathering assist apparatus associated with each packer box and carried by the mounting device including a drag and a sensor for sensing a portion of the drag associated with each packer box.

17. The binding line of claim 16, wherein the gathering assist apparatus further includes an additional drag.

18. The binding line of claim 16, wherein the gathering assist apparatus further includes a string reel.

19. The improvement of claim 16, wherein the mounting device is hollow and wherein the sensor develops a signal which is supplied over a wire to a controller and wherein the sensor wire is disposed within the hollow mounting rail.

* * * * *